US005720117A

United States Patent [19]

Toschi

[11] Patent Number: 5,720,117

[45] Date of Patent: Feb. 24, 1998

[54] ADVANCED TORQUE STABILITY SHOE SHANK

[75] Inventor: Michael R. Toschi, Redwood City, Calif.

[73] Assignee: Ariat International, Inc., San Carlos, Calif.

[21] Appl. No.: 758,293

[22] Filed: Dec. 3, 1996

Related U.S. Application Data

[63] Continuation of Ser. No. 491,480, Jun. 16, 1995, abandoned.

[51] Int. Cl.[6] ..... A43B 23/22

[52] U.S. Cl. ..... 36/76 R; 36/169

[58] Field of Search ..... 36/76 R, 168, 36/171, 177, 169

[56] References Cited

U.S. PATENT DOCUMENTS

| | | | |
|---|---|---|---|
| 1,208,397 | 12/1916 | Stimpson . | |
| 1,387,411 | 8/1921 | Kolkebeck . | |
| 1,462,798 | 7/1923 | Nickerson | 36/76 R |
| 1,490,991 | 4/1924 | Tilson et al. | 36/76 R |
| 1,732,951 | 10/1929 | Selby . | |
| 1,761,079 | 6/1930 | Lasky . | |
| 1,816,763 | 7/1931 | Bradford . | |
| 1,863,690 | 6/1932 | Hadaway . | |
| 1,895,660 | 1/1933 | Hauck | 36/76 R |
| 1,934,092 | 11/1933 | Rigante | 36/24.5 |
| 2,006,846 | 7/1935 | Thelen | 36/76 |
| 2,099,394 | 11/1937 | Gordon | 36/76 |
| 2,159,602 | 5/1939 | Quirk | 36/76 |
| 2,161,188 | 6/1939 | Nickerson | 36/76 R X |
| 2,168,606 | 8/1939 | Movsesian | 36/12 |
| 2,263,187 | 11/1941 | Parkhurst | 36/76 R X |
| 2,280,440 | 4/1942 | Melchionna | 36/76 |
| 2,322,297 | 6/1943 | Jalbert | 36/8.5 |
| 2,358,886 | 9/1944 | Sullivan | 36/76 R |
| 2,362,497 | 11/1944 | Moore | 36/76 R X |
| 2,407,498 | 10/1946 | Johnson | 36/2.5 |
| 2,442,007 | 5/1948 | Johnson | 36/76 |
| 2,505,706 | 4/1950 | Damon | 36/76 |
| 2,510,560 | 6/1950 | Daniels | 36/76 |
| 2,817,166 | 12/1957 | Riggs | 36/76 |
| 3,103,075 | 9/1963 | Paulding | 36/76 |
| 3,145,486 | 8/1964 | Petalas | 36/2.5 |
| 3,393,460 | 7/1968 | Romen | 36/68 |

FOREIGN PATENT DOCUMENTS

| | | | |
|---|---|---|---|
| 1234683 | 10/1960 | France | 36/76 R |

*Primary Examiner*—Ted Kavanaugh
*Attorney, Agent, or Firm*—Carr & Ferrell LLP

[57] ABSTRACT

A shank for providing stability and torsional control to a shoe comprises a generally rectangular body having a pair of legs extending non-symmetrically from a first end for providing flexibility at the ball of the shoe, and a semicircular tab formed from a second end for enhancing the rigidity and torsional stability. A crested ridge formed along the underside of the shank provides stiffness to the shank's body while the legs allow for flexibility in the shank to accommodate the slight angular bending, twisting or sideways rocking that occurs at the ball of the shoe. From a side view, the body of the shank is curved to look like a generally elongated S-shape which follows the inclined form of a shoe lasting board. A stabilizer protruding in relief from the top side of the shank is used to align the shank with the shoe lasting board prior to permanent affixation.

17 Claims, 2 Drawing Sheets

FIG. 5

ADVANCED TORQUE STABILITY SHOE SHANK

RELATED APPLICATIONS

This is a continuation of application Ser. No. 08/491,480 filed on Jun. 16, 1995 abandoned.

BACKGROUND OF THE INVENTION

1. Field of the Invention

This invention relates generally to shoe shanks or shank stiffeners for shoe arches, and more particularly to a shoe shank made of advanced composite materials and having controlled torsional stability providing a stable heel portion with a flexible ball portion.

2. Description of the Background Art

Traditionally, shoe shanks comprise an elongated rectangular piece of metal that is arched or S-shaped to follow the contour of a high-heeled shoe last. Improvements to the common shank include adding thickness to the shank to encourage (U.S. Pat. No. 3,103,075) or discourage (U.S. Pat. No. 1,732,951) pronation; adding prongs to the forward toe portion (U.S. Pat. Nos. 1,208,397, 1,387,411, 2,280,440, and 2,442,007) for flexibility; and having a convex curve at the heel end (U.S. Pat. No. 2,817,166) for enhanced stabilization.

U.S. Pat. No. 2,280,440 attempts to stabilize the heel portion of a shoe shank, while allowing the forward end portion to be flexible, by using elongated beads formed in relief on the underside of the shank. The beads impart a stabilizing effect to the shoe heel, reducing the occurrence of sidewise rocking of the heel during manufacture and use. Although rocking is reduced by the beads, the beads do not have much effect in stabilizing torque or twisting moments on the shank.

U.S. Pat. Nos. 1,816,763, 2,168,606 and 2,817,166 teach shoe shanks having apertures formed in the body of the shank for stabilizing the shank in preparation for fastening the shank and last. A set screw engages the aperture and holds the shank in place during manufacture of the shoe. None of the prior art patents mate a protruding stabilizer on the shank with an aperture in the last to ensure the correct positioning of the shank and the last prior to fastening the two members together.

What is needed is a shank that provides maximum torsional stiffness to reduce or eliminate twisting between the ball and heel portions of the shoe, while controllably allowing some flexibility from the ball to the toe of the shoe. Additionally, it is desirable to have a means for anchoring the shank to the last prior to fastening, such that, when anchored, the shank is aligned in proper disposition with the last.

SUMMARY OF THE INVENTION

The present invention is a shank that is built in to the arch of a shoe to provide stability and torsional control to the wearer. The shank of the present invention comprises a generally rectangular body having a pair of legs that extend non-symmetrically outward from a first end. The legs give the first end of the shank flexibility, and the non-symmetry of the legs accommodates the shape of the ball of the shoe. A semicircular tab is formed from a second end of the shank to enhance the rigidity and torsional stability of the second end. A crested ridge is formed along the underside of the body, building in thickness toward the longitudinal axis of the shank, and causes the shank to be very inflexible The body of the shank is curved to look like a generally elongated S-shape. This shape follows the inclined form of a shoe's last. A stabilizer protrudes in relief from the top side of the shank, proximate the shank's midsection, and is used to align the shank with the shoe lasting board prior to permanent affixation.

The shank of the present invention provides anisotropic support to the heel and arch portion of the shoe. The shank is preferably made of non-rusting, high strength, composite carbon fiber but may also be made of equivalent plastics, polymers or metals. The shank's shape follows the contour of a shoe from the ball section to the heel section, where a maximum amount of rigidity is desirable. The first end of the shank is thinner than the rest of the shank so as to be slightly flexible to accommodate the slight angular bending, twisting or sideways rocking that occurs at the ball of the shoe, when the shoe is worn. While reduced thickness of the first end allows flexibility, the full thickness of the rest of the shank body and second end provides maximum stability and torsional rigidity to the shank, preventing twisting or bending, and thus making walking more comfortable.

During manufacture of a shoe, the shank is permanently affixed to a lasting board which forms a part of the bottom section of the shoe. The shank is typically fastened to the lasting board by rivets or screws which are inserted through small apertures in the lasting board. The small apertures in the lasting board are aligned with similar apertures in the shank, while the stabilizer is aligned with a large aperture formed in the lasting board. The stabilizer mates with the aperture to properly align the shank and lasting board, and prohibit sliding or twisting between the shank and lasting board during installation of the fasteners.

DETAILED DESCRIPTION OF THE PREFERRED EMBODIMENT

Figure 1:
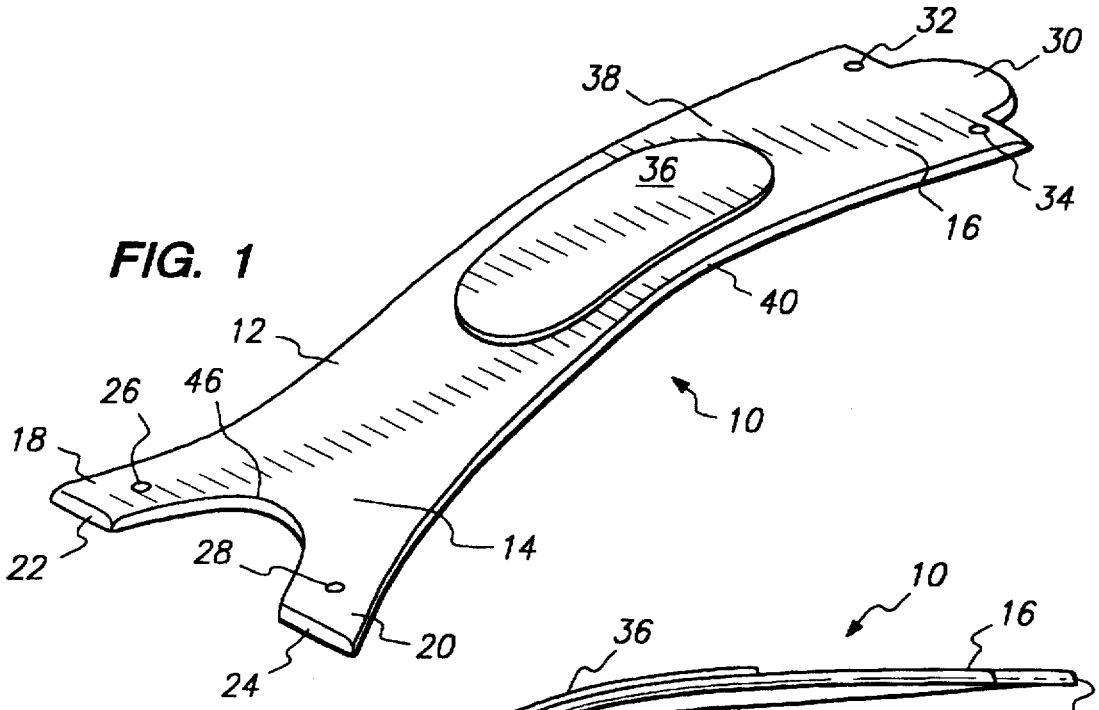
FIG. 1 is a perspective view of a shoe shank in accordance with the present invention.

Referring now to FIG. 1, a perspective view is shown of a shoe shank 10 in accordance with the present invention. Shoe shanks are built into the sole structure of a shoe and provide anisotropic support to the heel and arch portion of the shoe. The shank 10 of the present invention is preferably made of non-rusting, high strength, composite carbon fiber but may also be made of equivalent plastics, polymers or metals. The shank 10 comprises a generally rectangular body 12 with a first end 14 and a second end 16. The first end 14 has a pair of legs 18, 20 that extend non-symmetrically outwardly. The legs 18, 20 are joined at a common union 46. The distal end 22, 24 of each leg 18, 20 further includes an aperture 26, 28 for fastening the shank 10 to a shoe lasting board (not shown). The legs 18, 20 give the first end of the shank flexibility, and the non-symmetry of the legs 18, 20 accommodates the shape of the ball of the shoe. The non-symmetry of the legs 18, 20 will be further shown and discussed with reference to FIG. 3.

The second end 16 of the shank 10 includes a semicircular tab 30 that extends centrally therefrom. The tab 30 enhances the rigidity and torsional stability of the second end 16. A pair of small apertures 32, 34 are formed spaced apart at the second end 16, to each side of the tab 30. The apertures 32, 34 provide a means for fastening the shank 10 to a shoe lasting board (further shown and discussed with regard to FIG. 5). The body 12 of the shank 10 between the first and second ends 14, 16 is curved to look like a generally elongated S-shape. This shape follows the inclined form of the shoe's last. A stabilizer 36 is formed upon, and protrudes in relief from, the top side 38 of the shank 10. In the preferred embodiment, the stabilizer 36 is generally oval in shape and is disposed proximate the shank's midsection 40. During manufacture of a shoe, the stabilizer 36 is used to align the shank 10 with the shoe lasting board prior to permanent affixation. Subsequent to manufacture of a shoe, the stabilizer 36 provides a visual check to assure that a shank 10 was indeed built into the completed shoe.

Figure 2:
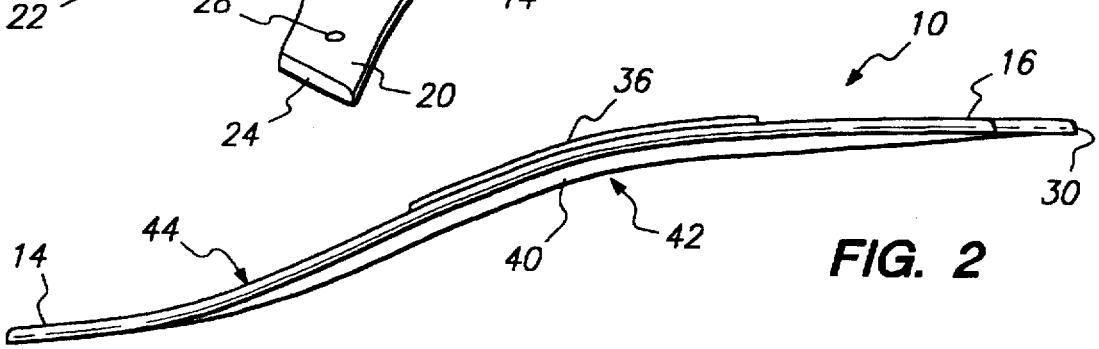
FIG. 2 is a side view of the shank shown in FIG. 1.

Referring now to FIG. 2, a side view of the shank 10 is shown illustrating the curved shape. The shank 10 has two bends 42, 44 between the first end 14 and the second end 16. The first bend 42 occurs proximate the midsection 40 of the shank 10 and provides a gentle slope between the first and second ends 14, 16. The second bend 44 is opposite in direction from the first bend 42 and occurs proximate the first end 14 of the shank 10, adjacent the union 46 of the pair of legs 18, 20. The shape of the shank 10 follows the contour of a shoe from the heel section to the ball section, where a maximum amount of rigidity is desirable. The thickness of the first end 14 is less than the thickness of the midsection 40 and less than the thickness of the second end 16. In this way, the first end 14 is slightly flexible to accommodate the slight angular bending, twisting or sideways rocking of the shank 10 that occurs at the ball of the shoe, when a shoe is worn. While reduced thickness of the first end 14 allows flexibility, the full thickness of the rest of the body 12 provides maximum stability and torsional rigidity to the shank 10, preventing twisting or bending, and thus making walking more comfortable. The shape and thickness of the shank 10 also provides resilience to the shoe, enabling the shoe to maintain its shape as the shoe is worn. This resiliency provided by the shank 10 effectively extends the useful life of the shoe.

Figure 3:
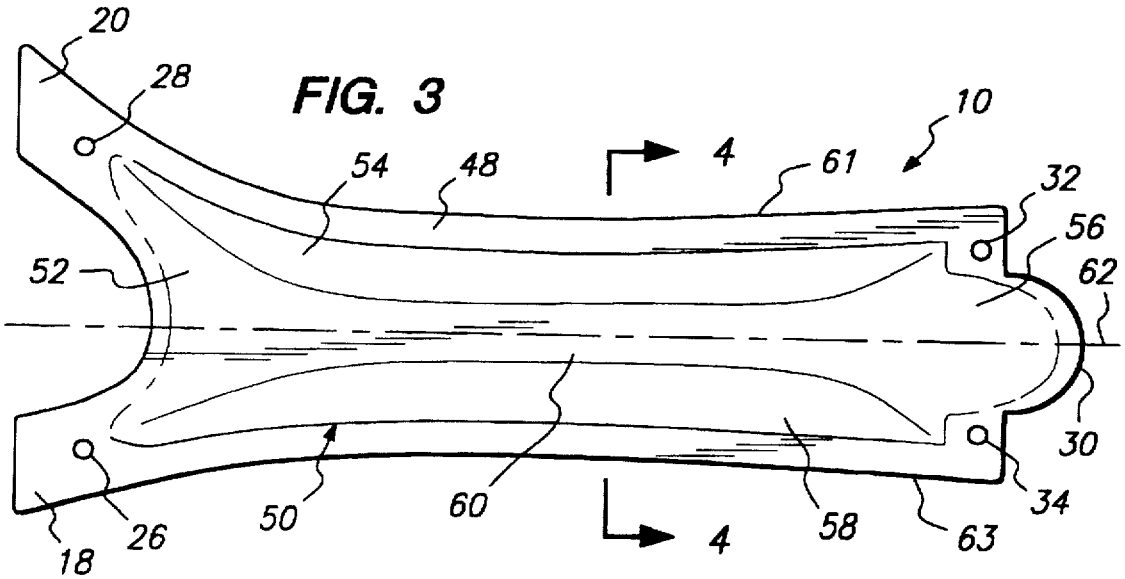
FIG. 3 is a bottom view of the shank shown in FIG. 1.
Figure 4:
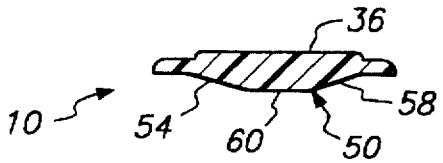
FIG. 4 is a cross-sectional view of the shank of FIG. 3 taken along the lines 4—4.

Referring now to FIG. 3, a bottom view of the shank 10 is illustrated. The non-symmetrical formation of the legs 18, 20 is more clearly shown in this figure. Leg 18 branches out from the first end 14 of the body 12 at a slight angle while leg 20 is longer than leg 18 and branches out from the body 12 at a greater angle. In this way, the shank 10 is foot specific. The shank 10 shown in FIG. 4 is a right-footed shank 10. The bottom side 48 further includes a ridge 50 formed therefrom. The area of the ridge 48 generally follows the outline of the body 12, with the exception of the legs 18, 20 and is formed from sloping sides 52, 54, 56, 58 that build to a crest 60 formed in parallel with the longitudinal axis 62 of the body 12.

The ridge 50 provides angular and torsional stability to the body 12 along the longitudinal axis 62. When a shank 10 is placed in a shoe, twisting forces are exerted upon the shank 10 as the wearer of the shoe walks. For comfort and stability, it is desirable for the shoe to be rigid in the midportion between the heel portion and the toe portion. The shank 10 is affixed to the shoe's midportion and provides the desired rigidity.

Referring now to FIG. 4, a cross-sectional view of the shank of FIG. 3 taken along the lines 4—4 is shown. The ridge 50 builds in thickness from the bottom side 48 of the body 12 to the crest 60. The sides 54, 58 are sloped or angled such that the ridge 50 is thinner proximate the sides 61, 63 of the shank, and the ridge 50 is thickest at the crest 60. Further, the crest 60 is flattened to enhance stability. The shape and formation of the crested ridge 50 provides torsional control to the shank 10. The body 12 of the shank 10 is kept from twisting by the ridge 50. The thickness of the ridge 50 corresponds to the torsional rigidity of the shank 10 such that the thicker the ridge 50, the less twisting flexibility there is in the shank 10.

Also shown in this figure is the stabilizer 36 formed in relief atop the top side 38 of the shank 10. The stabilizer 36 rises from the top side 38 of the shank 10 at the midsection 40 and may include text, a design or a logo molded into or further formed in relief upon the stabilizer 36.

Figure 5:
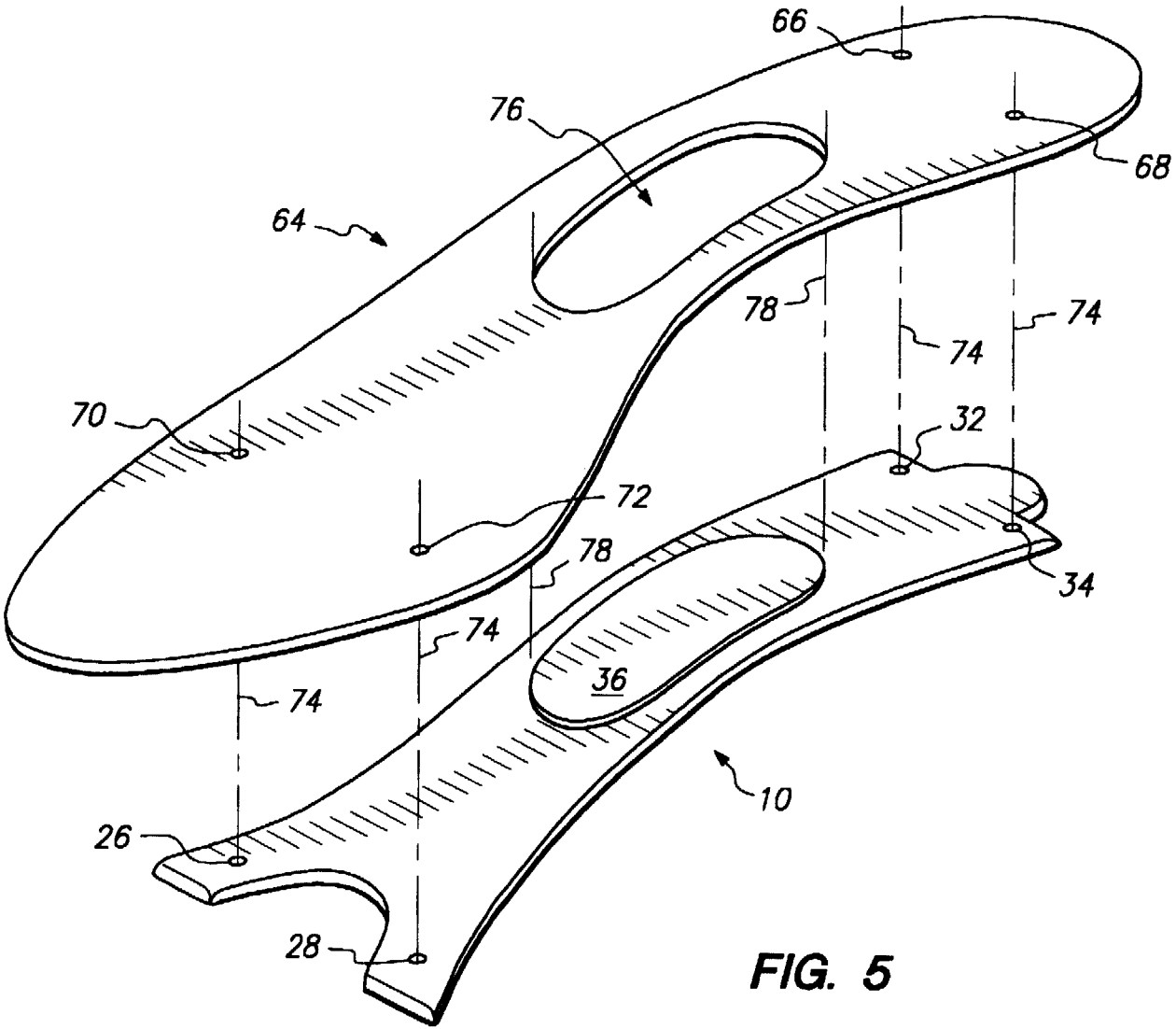
FIG. 5 is a perspective view of the shank of FIG. 1 and a lasting board illustrating, by correlation lines, how the stabilizer on the shank mates with the aperture formed in the last to properly align the shank and last during manufacture of a shoe.

Referring now to FIG. 5, a perspective view is shown of the shank 10 and a lasting board 64. During manufacture of a shoe, the shank 10 is permanently affixed to a lasting board 64, which forms a part of the bottom section of the shoe. The shank 10 is typically fastened to the lasting board 64 by nails or screws which are inserted through the four smaller apertures 66, 68, 70, 72 in the lasting board 64, however, other types of fasteners may equivalently be used. The four apertures 66, 68, 70, 72 in the lasting board 64 are aligned with the four apertures 26, 28, 32, 34 in the shank 10, as shown by correlation lines 74. The stabilizer 36 is aligned with a large aperture 76 formed in the lasting board 64, as shown by correlation lines 78. The stabilizer 36 mates with the aperture 76 to properly align the shank 10 and lasting board 64. Once proper alignment is achieved, the mating of the stabilizer 36 and aperture 76 prohibits the shear or rotational movement between the shank 10 and lasting board 64 that occurs during installation of the fasteners through the smaller apertures, in order to permanently affix the shank 10 to the lasting board 64.

The invention has now been explained with reference to specific embodiments. Other embodiments will be apparent to those of ordinary skill in the art in light of this disclosure. Therefore, it is not intended that this invention be limited, except as indicated by the appended claims.

What is claimed is:

1. A shank comprising:

an elongated body having a first end, a second end, an intermediate arched portion between said first and second ends, a top side, a bottom side and a longitudinal axis;

a pair of legs extending from said first end of said body; and a stabilizer protruding in relief from said top side of said arched portion for aligning the shank with a corresponding aperture in a shoe lasting board;

said bottom side of said body building in thickness to a ridge substantially parallel to said longitudinal axis.

2. The shank as recited in claim 1 made of composite carbon fiber.

3. The shank as recited in claim 1 wherein the arched portion of the body includes a first and a second bend, the first bend being formed proximate a midsection of the shank and the second bend being formed proximate the first end of the shank in the opposite direction of the first bend such that, together, the bends form the shank body into an elongated S-shape.

4. The shank as recited in claim 3 wherein the ridge provides rigidity to the shank from the second bend to the second end of the shank.

5. The shank as recited in claim 3 wherein the legs provide torsional flexibility in the shank from the second bend to the first end of the shank.

6. The shank as recited in claim 1 wherein a distal end of each of the pair of legs further includes an aperture formed therein.

7. The shank as recited in claim 1 further comprising a semicircular tab extending from the second end, and wherein the second end includes a pair of spaced apart apertures.

8. The shank as recited in claim 1 wherein the pair of legs extend non-symmetrically from the first end of the body and each leg narrows from the body towards the distal end of the leg to provide increased flexibility in the pair of legs.

9. The shank as recited in claim 1 further including first and second apertures formed at a distal end of respective legs, third and fourth apertures formed spaced apart at the second end of the shank, for affixing the shank to a shoe last by fastening means disposed through the first, second, third and fourth apertures.

10. The shank as recited in claim 9 wherein the fastening means are screws.

11. The shank as recited in claim 9 wherein the fastening means are rivets.

12. The shank of claim 1, wherein:

said stabilizer includes a logo, design or text molded into or formed in relief upon said stabilizer.

13. A shank, comprising:

an elongated body having a first end, a second end, an intermediate arched portion between said first and second ends, a top side, a bottom side and a longitudinal axis;

a pair of legs extending from said first end of said body; and an oval stabilizer protruding in relief from said top side of said arched portion for aligning said shank with a corresponding aperture in a shoe lasting board;

said bottom side of said body building in thickness to a ridge substantially parallel to said longitudinal axis.

14. A composite carbon fiber shank comprising:

an elongated body having a first end, a second end, an intermediate arched portion between said first and second ends, a top side, a bottom side and a longitudinal axis;

a pair of legs extending from said first end of said body;

a semicircular tab extending from said second end;

a stabilizer protruding in relief from said top side of said arched portion for aligning said shank with a corresponding aperture in a shoe lasting board, said stabilizer being visible through said aperture in said lasting board for providing visible verification of said shank's presence;

said bottom side of said body building in thickness to a rounded ridge in parallel with said longitudinal axis of said body.

15. The shank of claim 14, wherein:

said stabilizer includes a logo, design or text molded into or formed in relief upon said stabilizer.

16. A shank as in claim 14 and further comprising: a lasting board having an aperture and coupled to the shank to form an insole.

17. A shoe subcombination comprising:

a lasting board having an aperture; and a shank attached to said lasting board, said shank including an elongated body having a first end, a second end, an intermediate arched portion between said first and second ends, a top side, a bottom side and a longitudinal axis;

a pair of legs extending from said first end of said body; and a stabilizer protruding in relief from said top side of said arched portion, fitting within said aperture, and having formed thereon a logo, design or text visible through said aperture;

said bottom side of said body building in thickness to a ridge substantially parallel to said longitudinal axis.

* * * * *